US008900103B1

(12) United States Patent
Tabino

(10) Patent No.: US 8,900,103 B1
(45) Date of Patent: Dec. 2, 2014

(54) EXERCISE MECHANISM

(76) Inventor: Thomas J. Tabino, North East, MD (US)

( * ) Notice: Subject to any disclaimer, the term of this patent is extended or adjusted under 35 U.S.C. 154(b) by 234 days.

(21) Appl. No.: 13/225,649

(22) Filed: Sep. 6, 2011

(51) Int. Cl.
*A63B 69/22* (2006.01)
*A63B 69/34* (2006.01)

(52) U.S. Cl.
USPC ..... 482/87; 482/83

(58) Field of Classification Search
USPC ..... 482/83–90; 273/440, 440.1; 473/441–445
See application file for complete search history.

(56) References Cited

U.S. PATENT DOCUMENTS

| | | | | | |
|---|---|---|---|---|---|
| 1,444,542 | A * | 2/1923 | Grossheim | 248/317 |
| 1,851,649 | A * | 3/1932 | Schindler | 482/87 |
| 1,890,696 | A * | 12/1932 | Rosenhahn | 482/90 |
| 2,548,089 | A * | 4/1951 | Wycosky | 482/87 |
| 2,890,049 | A * | 6/1959 | Lewis | 482/87 |
| 3,400,440 | A * | 9/1968 | Carlson | 29/890.121 |
| 4,163,617 | A * | 8/1979 | Nemoto | 403/132 |
| D258,115 | S * | 2/1981 | Piatek | D8/373 |
| 4,345,755 | A * | 8/1982 | Eidson | 482/87 |
| 4,953,852 | A * | 9/1990 | Donohue | 482/87 |
| 4,974,836 | A * | 12/1990 | Hirsch | 482/40 |
| 5,800,320 | A | 9/1998 | Ray | |
| 6,090,018 | A | 7/2000 | Laudenslager et al. | |
| D440,269 | S | 4/2001 | Thomas | |
| 6,461,281 | B2 * | 10/2002 | Bouvier | 482/86 |
| 7,438,674 | B2 * | 10/2008 | Sjodin | 482/91 |
| 2004/0258463 | A1 * | 12/2004 | Dorr | 403/137 |
| 2006/0025285 | A1 | 2/2006 | Giusti | |
| 2007/0167297 | A1 * | 7/2007 | Stevenson | 482/83 |
| 2008/0171643 | A1 * | 7/2008 | Baudhuin | 482/148 |
| 2010/0167882 | A1 * | 7/2010 | Colk et al. | 482/71 |

* cited by examiner

*Primary Examiner* — Loan H Thanh
*Assistant Examiner* — Gregory Winter
(74) *Attorney, Agent, or Firm* — Crossley Patent Law

(57) ABSTRACT

An exercise mechanism that includes a speed ball-type punching bag that is mounted onto a support via a D-shackle that is attached to a loop on the support. The support also has a ball end which is connected to a ceiling mount, with the ball end being supported by a number of ball bearings within the mount and also by the use of a retention washer within the mount. In use, the punching bag provides very liberal movement in all directions while in use due to the presence of the ball end in combination with the ball bearings and the retention washer.

5 Claims, 3 Drawing Sheets

EXERCISE MECHANISM

BACKGROUND OF THE INVENTION

Various types of exercise mechanisms are known in the prior art. However, what is needed is an exercise mechanism that includes a speed ball-type punching bag that is attached to a ceiling wall surface via a support that includes a ball end, allowing liberal movement of the punching bag when in use.

FIELD OF THE INVENTION

The present invention relates to an exercise mechanism, and more particularly, to an exercise mechanism that provides features and characteristics above and beyond existing exercise mechanisms.

SUMMARY OF THE INVENTION

The general purpose of the present exercise mechanism, described subsequently in greater detail, is to provide an exercise mechanism which has many novel features that result in an exercise mechanism which is not anticipated, rendered obvious, suggested, or even implied by prior art, either alone or in combination thereof.

To accomplish this, the present exercise mechanism comprises a speed ball-type punching bag that is mounted onto a support via a D-shackle that is attached to a loop on the support. The support also has a ball end which is connected to a ceiling mount, with the ball end being supported by a number of ball bearings within the mount and also by the use of a retention washer within the mount. In use, the punching bag provides very liberal movement in all directions while in use due to the presence of the ball end in combination with the ball bearings and the retention washer.

Thus has been broadly outlined the more important features of the present exercise mechanism so that the detailed description thereof that follows may be better understood and in order that the present contribution to the art may be better appreciated.

DETAILED DESCRIPTION OF THE DRAWINGS

Figure 1:
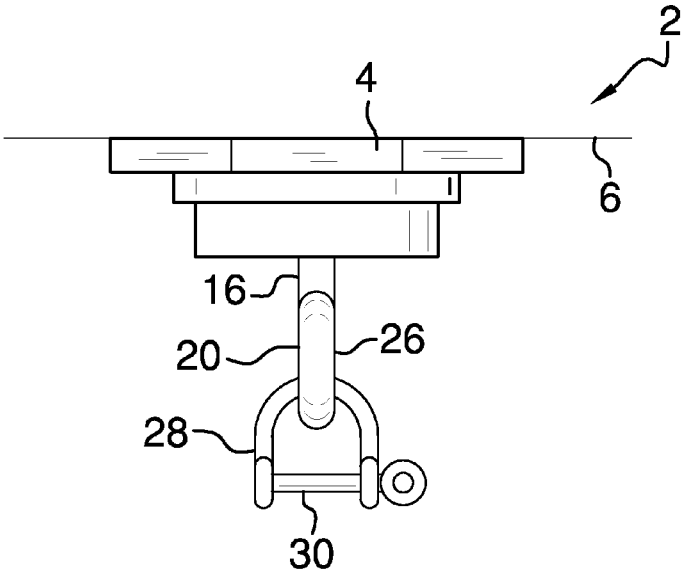
FIG. 1 is a front view of the exercise mechanism.
Figure 2:
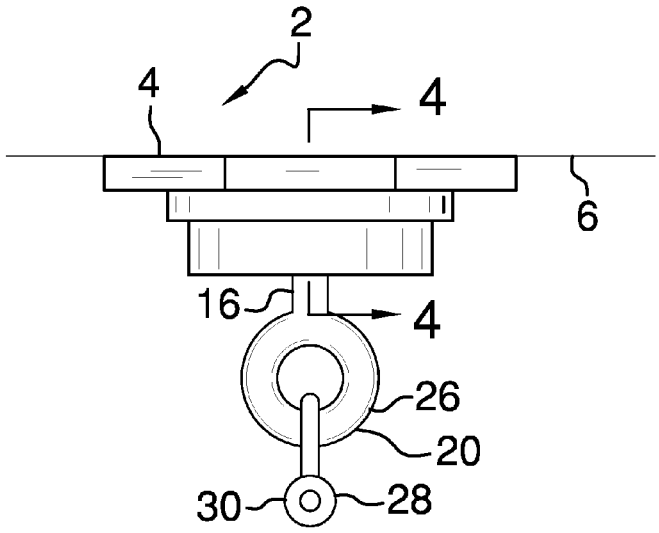
FIG. 2 is a side view of the exercise mechanism.
Figure 3:
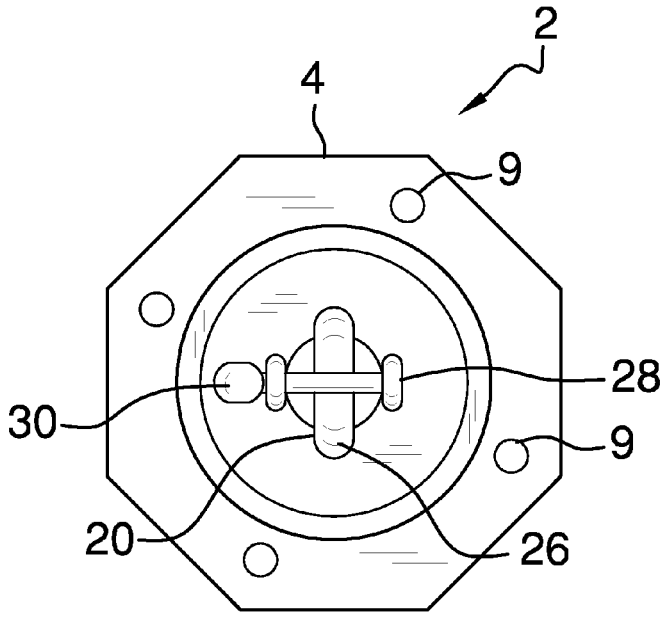
FIG. 3 is a top view of the exercise mechanism.
Figure 4:
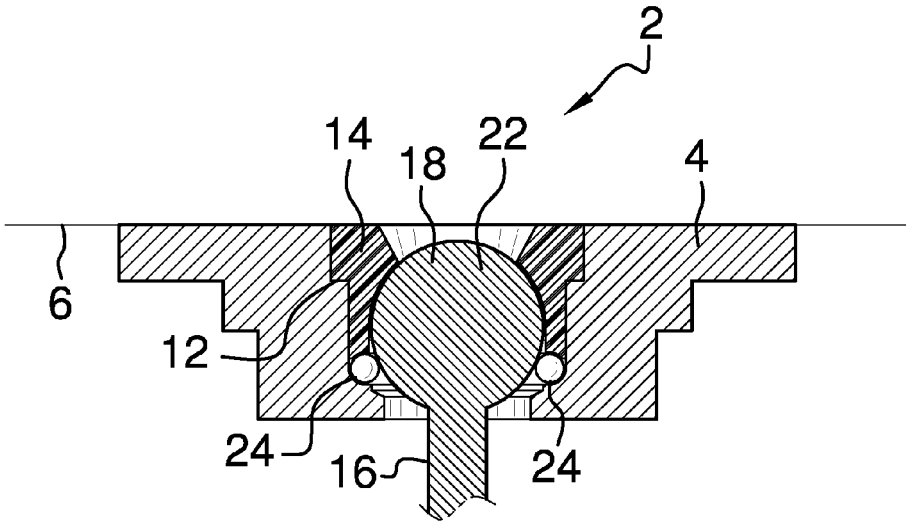
FIG. 4 is a cross-sectional view of the exercise mechanism.
Figure 5:
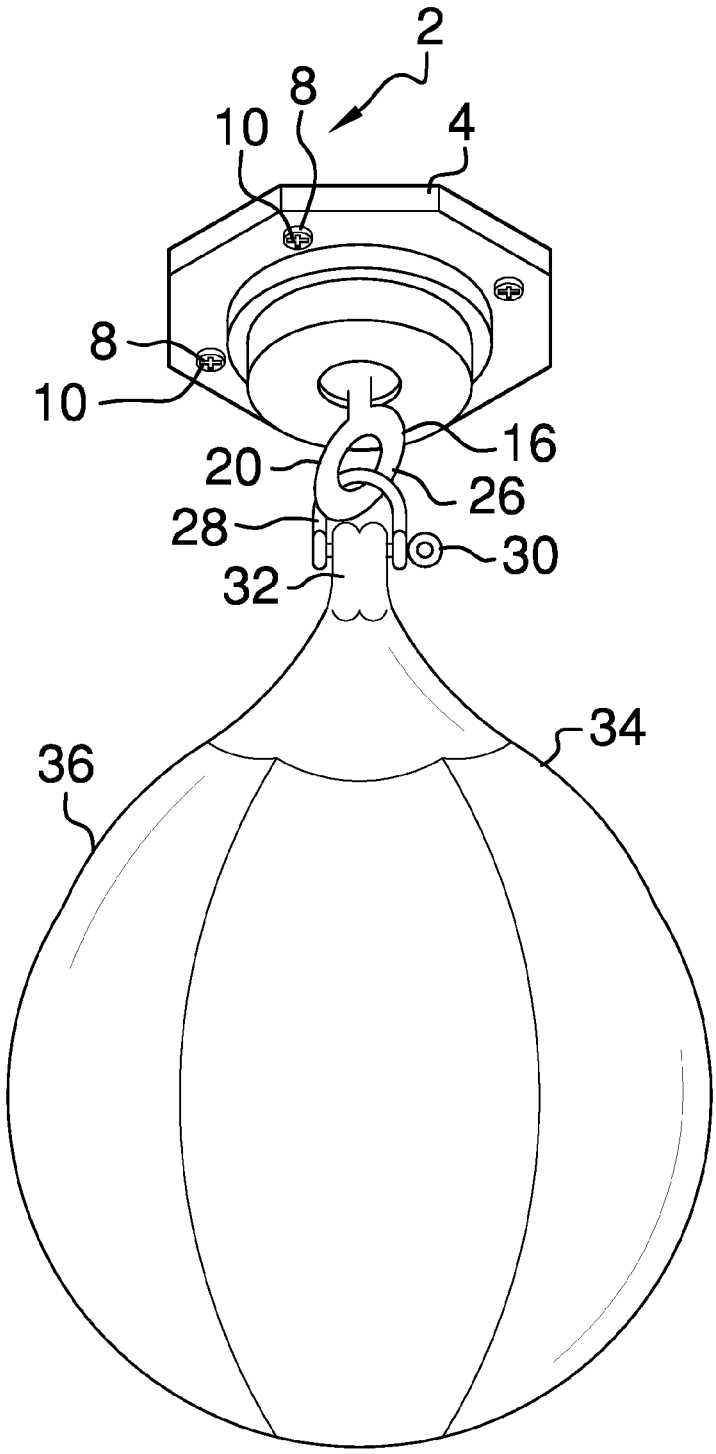
FIG. 5 is a perspective view of the exercise mechanism as it would appear in use.

With reference now to the drawings, and in particular FIGS. 1 through 5 thereof, an example of the instant exercise mechanism employing the principles and concepts of the present exercise mechanism and generally designated by the reference number 2 will be described.

Referring to FIGS. 1 through 5, a preferred embodiment of the present exercise mechanism 2 is illustrated. The exercise mechanism 2 comprises a mount 4 that is fastened to a ceiling wall surface 6 by a plurality of fasteners 8. The fasteners 8 are preferably screws 10, although other fasteners 8 could be used. Each fastener 8 is inserted through a hole 9 located on the mount 4 before being driven into the ceiling wall surface 6.

A cavity 12 is located within the mount 4, with a retention washer 14 being located within the cavity 12. Associated with the cavity 12 is a support 16, with support 16 including two ends comprising a first end 18 and a second 20. The first end 18 of the support 16 has an attached ball end 22 which is located within the retention washer 14 located within the cavity 12. A plurality of ball bearings 24 are associated with the ball end 22, allowing the ball end 22 of the support to rotate about freely within the cavity.

The second end 20 of the support 16 has an attached loop 26. A D-shackle 28 is placed through the loop 26, with a pin 30 being inserted through a connector 32 on a punching bag 34. The pin 30 is also removably connected to the D-shackle 28 and allows the punching bag 34 to hang freely from the D-shackle 28 and loop 26.

The punching bag 34 can be almost any type of punching bag 34, but preferably is a punching bag 34 informally known as a speed ball 36 type of punching bag 34. The speed ball 36 generally provides less power to a boxer when a boxer may be training, but provides increased dexterity and coordination when properly used.

What is claimed is:

1. An exercise mechanism comprising:

a mount, wherein the mount is attached to a ceiling wall surface;

a support, the support having two ends comprising a first end and a second end, wherein the first end of the support is attached to the mount;

a loop, wherein the loop is attached to the second end of the support;

a connector shackle, wherein the connector shackle pivotally engages the loop;

a punching bag;

a pin;

wherein the pin is inserted through the punching bag, further wherein the pin is inserted through the connector shackle, thereby causing the punching bag to be suspended from the support;

wherein the connector shackle is a D-shackle;

a connector on the punching bag;

wherein the pin is inserted through the connector on the punching bag prior to being inserted through the connector shackle, thereby causing the punching bag to be suspended from the support;

a cavity located within the mount;

a retention washer located within the cavity within the mount;

a plurality of ball bearings located within the cavity within the mount;

a ball end positioned at the first end of the support;

wherein the ball end of the support rotates around freely within the cavity.

2. An exercise mechanism according to claim 1 wherein the exercise mechanism further comprises:

a plurality of fasteners;

a plurality of holes on the mount;

wherein each fastener is inserted through a hole of the plurality of holes on the mount before being driven into the ceiling wall surface.

3. An exercise mechanism according to claim 2 wherein the plurality of fasteners comprises a plurality of screws.

4. An exercise mechanism according to claim 3 wherein the punching bag comprises a speed ball-type of punching bag.

5. An exercise mechanism comprising:

a mount;

a plurality of holes on the mount;

a plurality of fasteners; wherein the plurality of fasteners comprises a plurality of screws; wherein each fastener of the plurality of fasteners is inserted through a hole of the plurality of holes on the mount before being driven into a ceiling wall surface;

a support, the support having two ends comprising a first end and a second end, wherein the first end of the support is attached to the mount;

a cavity located within the mount;

a retention washer located within the cavity within the mount;

a plurality of ball bearings located within the cavity within the mount;

positioned at the first end of the support, wherein the ball end of the support rotates around freely within the cavity;

a loop, wherein the loop is attached to the second end of the support;

a connector shackle, wherein the connector shackle pivotally engages the loop, wherein the connector shackle is a D-shackle;

a punching bag, wherein the punching bag includes a connector; wherein the punching bag comprises a speed ball-type of punching bag;

a pin;

wherein the pin is inserted through the connector on the punching bag prior to being inserted through the connector shackle, thereby causing the punching bag to be suspended from the support.

* * * * *